US008881696B2

(12) United States Patent
Kunert

(10) Patent No.: US 8,881,696 B2
(45) Date of Patent: Nov. 11, 2014

(54) TWO-STROKE ENGINE

(75) Inventor: Niels Kunert, Ottenbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 283 days.

(21) Appl. No.: 13/225,864

(22) Filed: Sep. 6, 2011

(65) Prior Publication Data

US 2012/0060806 A1 Mar. 15, 2012

(30) Foreign Application Priority Data

Sep. 10, 2010 (DE) ..... 10 2010 045 017

(51) Int. Cl.

| | |
|---|---|
| ***F02B 17/00*** | (2006.01) |
| ***F02B 25/22*** | (2006.01) |
| ***F02B 33/04*** | (2006.01) |
| ***F02B 25/14*** | (2006.01) |
| *F01L 5/06* | (2006.01) |
| *F02B 75/02* | (2006.01) |
| *F02B 3/00* | (2006.01) |
| *F02B 1/00* | (2006.01) |

(52) U.S. Cl.

CPC . *F02B 25/14* (2013.01); *F01L 5/06* (2013.01); *F02B 25/22* (2013.01); *F02B 2075/027* (2013.01); *F02B 3/00* (2013.01); *F02B 17/00* (2013.01); *F02B 33/04* (2013.01); *F02B 1/00* (2013.01)

USPC ..... 123/76

(58) Field of Classification Search

CPC ..... F02B 1/00; F02B 2075/027; F02B 3/00; F02B 17/00

USPC ..... 123/76

See application file for complete search history.

(56) References Cited

U.S. PATENT DOCUMENTS 7,082,910 B2 8/2006 Carlsson et al.
2008/0302344 A1 * 12/2008 Kunert et al. ..... 123/73 PP

* cited by examiner

*Primary Examiner* — Lindsay Low
*Assistant Examiner* — Charles Brauch
(74) *Attorney, Agent, or Firm* — Gudrun E. Huckett

(57) ABSTRACT

A two-stroke engine has a cylinder having a cylinder bore with a combustion chamber and an outlet connected with the combustion chamber. A piston is disposed in the cylinder and delimits the combustion chamber. The piston has a piston recess. A crankcase is provided that has a crankshaft rotatably supported therein. The piston drives in rotation the crankshaft. In at least one position of the piston, the crankcase is connected by a transfer passage with the combustion chamber. An air passage is provided as well as a mixture passage that has a mixture inlet that is disposed at the cylinder bore and opens into the cylinder bore and is piston-controlled. The transfer passage is connected by the piston recess to the air passage when the piston is at top dead center. The piston recess has a connection to the mixture inlet in at least one position of the piston.

23 Claims, 6 Drawing Sheets

TWO-STROKE ENGINE

BACKGROUND OF THE INVENTION

The invention relates to a two-stroke engine comprising a cylinder with a combustion chamber provided therein that is delimited by a piston. The piston drives in rotation a crankshaft that is rotatably supported in a crankcase. In at least one position of the piston, the crankcase is connected by means of at least one transfer passage with the combustion chamber. An outlet is provided at the combustion chamber. An air passage is provided as well as a mixture passage that opens with a mixture inlet into the cylinder bore and is piston-controlled by the piston. The transfer passage is connected in the area of top dead center of the piston by means of a piston recess to the air passage. The invention further relates to a hand-held power tool with such an engine.

U.S. Pat. No. 7,082,910 B2 discloses a two-stroke engine comprising an air passage and a mixture passage. By means of the air passage scavenging air is supplied to the transfer passages through a piston recess. The scavenging air is supposed to separate the fresh mixture that is flowing from the crankcase into the combustion chamber from the exhaust gases in the combustion chamber that are flowing out through the outlet in order to thus reduce scavenging losses.

It has been found that two-stroke engines that operate with scavenging air may stall as engine speeds decrease under load.

SUMMARY OF THE INVENTION

It is an object of the present invention to provide a two-stroke engine of the aforementioned kind that even for decreasing engine speed under load has a stable running behavior. A further object of the invention is to provide a hand-held power tool whose two-stroke engine exhibits a stable running behavior.

In accordance with the present invention, this is achieved in that the piston recess in at least one position of the piston is connected to the mixture inlet.

In accordance with the present invention, this is achieved in regard to the hand-held power tool provided with a two-stroke engine of the present invention in that the fuel port in the regular working position of the hand-held power tool is disposed above the air passage relative to the effective direction of gravity.

In order to achieve minimal exhaust gas values the fuel supply to the engine is to be reduced as much as possible. When the engine speed at full throttle decreases as a result of increasing load, the supplied fuel quantity can become too small causing the engine to stall. In order to avoid this, it is desirable that at low engine speeds additional fuel is supplied.

In order to be able to supply additional fuel in a simple way, it is provided that the piston recess through which the scavenging air is supplied into the transfer passage is connected to the mixture inlet, i.e., mixture may be transferred into the piston recess. In this way, a defined enrichment of the mixture is achieved.

Advantageously, this connection is existing at least partially while the piston recess is connected with the transfer passage. By means of the transfer passage, upon upward stroke of the piston underpressure (vacuum) is produced in the piston recess' that sucks in mixture from the mixture inlet into the piston recess. By means of the length of the time period during which the piston recess is connected to the transfer passage as well as to the mixture inlet, the mixture quantity supplied into the piston recess can be adjusted.

Advantageously, for a crank angle range of approximately 5° to approximately 25°, the piston recess is connected to (communicates with) the mixture inlet and the transfer passage at the same time. Because of this comparatively short duration, only a minimal mixture quantity is supplied to the piston recess. The duration that is defined by the control times (engine timing) is advantageously determined such that a mixture transfer into the piston recess and into the transfer passage is realized only at low engine speeds. At higher engine speeds, in particular at the nominal engine speed, the length of time during which the connection from the mixture inlet to the transfer passage through the piston recess is existing is so short that no mixture or no significant quantity of mixture will pass into the piston recess. As a result of the short control times, the connection acts as a dynamic throttle that only at low engine speeds allows mixture to be transferred and at high engine speeds, in particular at nominal engine speed, will essentially block or close the connection. In this way, the achieved excellent exhaust gas values at nominal engine speed can be maintained and, at the same time, an excessive leaning of the mixture as the engine speed drops under load is prevented. Advantageously, the piston recess is simultaneously connected to (simultaneously communicates with) the mixture inlet and the transfer passage for a crank angle range of approximately 10° to approximately 20°.

Advantageously, the air passage opens with at least one air inlet into the cylinder bore. The air inlet is advantageously dosed relative to the piston recess while the piston recess is connected to (communicated with) the mixture inlet. In this way, soiling of the air passage with fuel from the mixture passage is prevented. Since the piston recess is connected to (communicates with) the mixture inlet and to the air inlet at different control times, it is still possible to supply and store substantially fuel-free scavenging air in the transfer passage, despite the connection of the piston recess with the mixture passage. The piston recess is in particular connected to the mixture passage while the outlet from the combustion chamber is closed by the piston.

A simple configuration results when the connection is formed at least partially by a depression in the piston and/or by a depression in a wall of the cylinder bore. Such a connection can be produced in a simple way and is piston-controlled by the piston so that the control times are predetermined by constructive measures.

The height of the depression that is measured in the direction of the longitudinal cylinder axis is advantageously smaller than the height of the mixture inlet also measured in the direction of the longitudinal cylinder axis. The height of the depression is advantageously approximately one half to approximately one fifth of the height of the mixture inlet.

A simple configuration results when the connection is formed by a nose provided at the piston recess and laterally projecting into the area of the mixture inlet. The nose extends in this connection in the circumferential cylinder direction advantageously across less than half, in particular across less than one third, of the width of the mixture inlet. By a suitable selection of the width of the nose as well as by a suitable selection of the control times the supplied mixture quantity can be influenced. Advantageously, the depth of the nose that is measured in radial direction relative to the longitudinal cylinder axis matches at least the length of the overlap of the nose and of the mixture inlet measured in the circumferential direction. The cross-sectional opening area that is determined by the overlap and the height of the nose determines in this way the mixture quantity that is supplied into the piston recess and also the engine speed range in which the connection is effective. Since the depth of the nose is of the same size or greater than the overlap, the same or a greater flow cross-section as in the connecting port results. The connecting passage between mixture inlet and piston recess that is formed by the nose has the smallest cross-section at the opening into the mixture inlet. The further passage configuration provides no further throttle location. In this way, a defined adjustment of the desired cross-section is possible.

Advantageously, the cylinder has a center plane that divides the outlet and in which the longitudinal cylinder axis is positioned. In particular, on both sides of the cylinder relative to the center plane at least one transfer passage and one piston recess are arranged. A simple configuration results went two piston recesses that are arranged on opposite sides of the center plane are connected with each other by a connecting groove in the piston. The connecting groove can be formed as a depression within the piston and provides the connection between the piston recesses and the mixture inlet. In this way, a simple configuration is provided.

Advantageously, the air passage and the mixture passage extend at least about a section of their length in a common intake passage and are separated from each other by a partition. By disposing air passage and mixture passage in a common intake passage, the required constructive space is reduced and a simple configuration results. In particular, the two-stroke engine has a carburetor in which a throttle valve is pivotably supported wherein in the area of the throttle valve a fuel port opens into the mixture passage. For a hand-held power tool with a two-stroke engine it is provided that the fuel port, in the regular working position of the power tool relative to the effective direction of gravity, is positioned above the air passage. The proposed connection of piston recess and mixture inlet is particularly advantageous for this type of arrangement of the two-stroke engine in a hand-held power tool.

DESCRIPTION OF THE PREFERRED EMBODIMENTS

Figure 1:
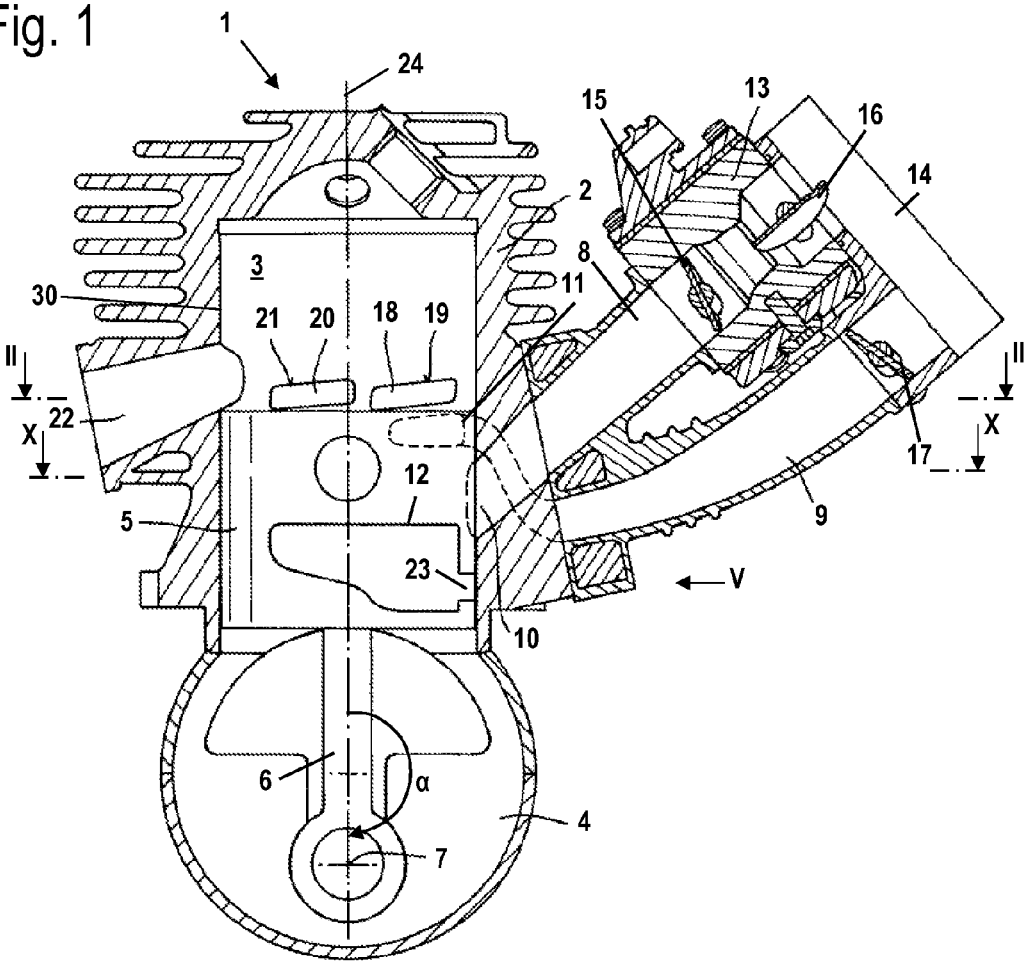
FIG. 1 is a schematic section illustration of a two-stroke engine.
Figure 2:
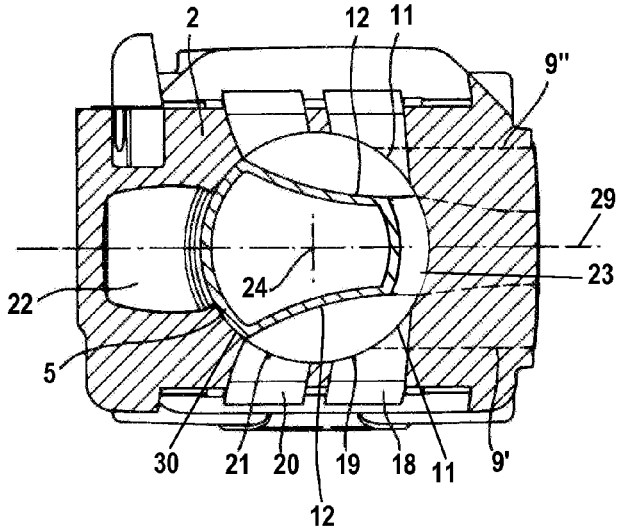
FIG. 2 is a schematic section illustration of the cylinder of the two-stroke engine of FIG. 1 at the level indicated by section line II-II.

FIG. 1 shows a two-stroke engine 1 that is operating with scavenging air and is embodied as a single cylinder engine. The engine may be advantageously provided as a drive motor of a hand-held power tool such as a motor chainsaw, a cut-off machine, a trimmer, a lawnmower or the like. The two-stroke engine 1 has a cylinder 2 in which a combustion chamber 3 is formed. The combustion chamber 3 is delimited by a piston 5 that is supported reciprocatingly within the cylinder 2 and, by means of a connecting rod 6, is driving a crankshaft 7 rotatably supported in the crankcase 4. At the cylinder bore 30 of the cylinder 2 a mixture passage 8 opens by means of a mixture inlet 10 that is piston-controlled by piston 5. The two-stroke engine 1 has an air passage 9 that is divided in the area of the cylinder 2 into the two branches 9' and 9" (FIG. 2). Each branch 9', 9" of the air passage 9 opens with an air inlet 11 at the cylinder bore 30. An outlet 22 communicates with the combustion chamber 3. The two-stroke engine 1 has a center plane 29 that is the section plane of FIG. 1 and that is illustrated in FIG. 2. In the center plane 29 the longitudinal cylinder axis 24 is located; the center plane 29 divides the outlet 22. In the illustrated embodiment the center plane 29 also divides the mixture inlet 10. At bottom dead center of the piston 5 (illustrated in FIG. 1) the interior of the crankcase 4 is connected by means of a total of four transfer passages 18, 20 to the combustion chamber 3. In this connection, two inlet-near transfer passages 18 and two outlet-near transfer passages 20 are provided. The transfer passages 18 open with transfer ports 19 into the combustion chamber 3 and the transfer passages 20 open with transfer ports 21 into the combustion chamber 3. All transfer ports 19, 21 are piston-controlled by piston 5.

The air passage 9 and the mixture passage 8 are connected to an air filter 14. In the air passage 9 a choke flap 17 for controlling the supplied air quantity is arranged. The mixture passage 8 opens by means of carburetor 13 at the air filter 14. A throttle valve 15 and a choke valve 16 are arranged in the carburetor 13. The movement of the choke flap 17 is advantageously coupled to the movement of the throttle valve 15.

The piston 5 has on each side of the center plane 29 a piston recess 12 that, in the area of top dead center TDC (FIG. 4) of the piston 5, provides the connection between air inlet 11 and the two transfer passages 18 and 20 that are arranged on this side of the center plane 29. In this way, in the transfer passages 18 and 20 substantially fuel-free air is supplied and stored. The two piston recesses 12 are connected to (communicate with) each other by a connecting groove 23 that is formed as a depression at the circumference of the piston 5 and that provides by a constructively predetermined control time a connection between the piston recesses 12 and the mixture inlet 10. By means of the connecting groove 23 the two piston recesses 12 are connected to each other.

In operation, upon upward stroke of the piston 5 mixture is sucked into the crankcase 4 as soon as the mixture inlet 10 has been released by the piston 5. In the area of top dead center of the piston 5 each one of the air inlets 11 is connected with (communicates with) transfer ports 19, 21 by means of a piston recess 12. In this way, scavenging air from the air passage 9 is supplied to and stored in the transfer passages 18 and 20. Upon downward stroke of the piston 5, the fuel/air mixture in the crankcase 4 is compressed. As soon as the transfer port 19 and transfer port 21 are released by the piston 5, first the scavenging air that is stored in the transfer passages 18 and 20 flows into the combustion chamber 3; subsequently, fresh mixture from the crankcase 4 flows into the combustion chamber 3. Upon upward stroke of the piston 5, the mixture in the combustion chamber 3 is compressed and in the area of top dead center TDC of the piston is ignited by means of a spark plug (not illustrated in the Figures). This causes the piston 5 to be accelerated in the direction toward the crankcase 4. As soon as the outlet 22 is released by the piston 5, the exhaust gases will exit from the combustion chamber 3 through the outlet 22. Residual exhaust gases are scavenged by the incoming scavenging air as soon as the transfer ports 19, 21 have been released by the piston 5.

It has been found that, as the engine speed n drops from full throttle under load, the fuel quantity that is flowing into the combustion chamber 3 may be too small so that the two-stroke engine 1 may stall. In order to ensure that there is always a sufficient fuel quantity in the combustion chamber 3, it is provided to introduce mixture from the mixture passage 8 through the piston recess 12 into the transfer passages 18 and 20. For this purpose, the connecting groove 23 is provided. The connecting groove 23 provides a connection between the mixture inlet 10 and the piston recess 12. This connection exists for a range of the crank angle $\alpha$ of approximately 5° up to approximately 25°, in particular for approximately 10° to approximately 20° of the crank angle $\alpha$, while the piston recess 12 is already open toward the transfer passages 18 and 20. In this way, additional mixture from the mixture passage 8 is sucked through the piston recess 12 into the transfer passages 18 and 20. Subsequently, air from the air inlet 11 can be supplied to and stored in the transfer passages. The mixture can be transferred into the transfer passages 18, 20 while the piston recess 12 is already closed relative to the mixture inlet 10.

Figure 3:
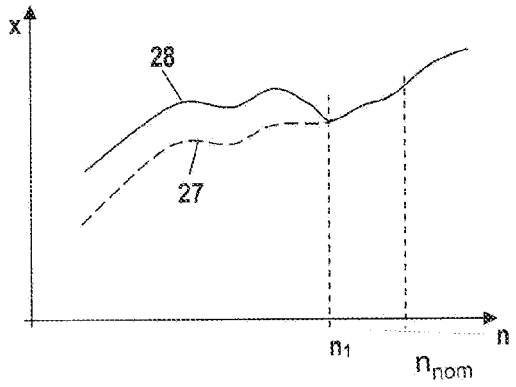
FIG. 3 shows a diagram that schematically indicates for a two-stroke engine the supplied fuel quantity plotted against the engine speed.

FIG. 3 shows schematically the supplied fuel quantity for a two-stroke engine 1 without connecting groove 23 by means of dashed curve 27. As indicated by the curve 27, the supplied fuel quantity x increases substantially with increasing engine speed n. The curve 28 indicates the supplied fuel quantity x for a two-stroke engine 1 with connecting groove 23. Here, the supplied fuel quantity x initially increases but drops then below an engine speed $n_1$. Above the engine speed $n_1$ the curve 28 coincides with the curve 27. Here, an increase of the supplied fuel quantity x results. The nominal engine speed $n_{nom}$ of the two-stroke engine 1 is above the engine speed $n_1$. The engine speed $n_1$, depending on the two-stroke engine 1, can be, for example, approximately 8,000 up to approximately 10,000 rpm (revolutions per minute). As shown in FIG. 3, the connecting groove 23 below the engine speed $n_1$ causes an increase of the supplied fuel quantity x. Above the engine speed $n_1$ the connecting groove 23 has no effect on the supplied fuel quantity x. The connecting groove 23 is dimensioned such that the connection at engine speeds above the engine speed $n_1$ is no longer effective. At high engine speeds n the dynamic throttling action is so great that mixture can no longer be sucked into the piston recess 12.

Figure 4:
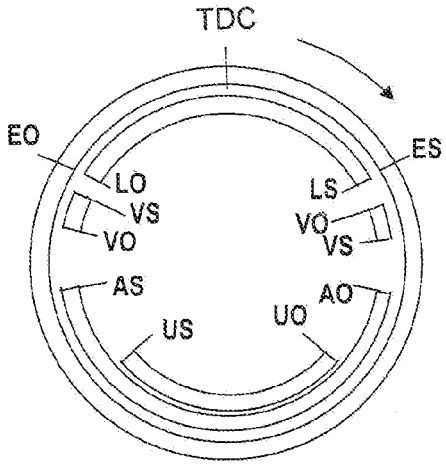
FIG. 4 is a schematic illustration of the control times (engine timing) of the two-stroke engine.

FIG. 4 illustrates the control times of the two-stroke engine 1. Starting from top dead center TDC first the mixture inlet 10 at the point in time ES is closed. Subsequently, the connection between the mixture inlet 10 and the piston recess 12 and the transfer passages 18, 20 opens at the point in time VO because the connecting groove 23 is now in the area of the mixture inlet 10. At this point in time, the piston recess 12 also opens toward the transfer ports 19 and 21. At the point in time VS, the connection between the transfer passages 18, 20 and the mixture passage 8 through the piston recess 12 is closed again, in particular in that the transfer ports 19 and 21 are dosed. The connecting groove 23 at the point in time VS may still be in the area of the mixture inlet 10 so that the piston recess 12 continues to be connected to (communicate with) the mixture inlet 10. Upon further downward stroke of the piston 5, the outlet 22 opens at the point in time AO. Subsequently, the transfer passages 18 and 20 open at the point in time UO into the combustion chamber.

Upon upward stroke of the piston 5, first the transfer passages 18, 20 dose at the point in time US and subsequently the outlet 22 closes at the point in time AS. Subsequently, the connection between mixture inlet 10 and transfer passages 18, 20 opens again at the point in time VO and closes again at the point in time VS. Only thereafter, the mixture inlet 10 opens toward the crankcase 4 at the point in time EO. The connection between mixture inlet 10 and piston recess 12 therefore exists while the outlet 22 is closed and the mixture inlet 10 is closed relative to the crankcase 4. The air inlet 11 is also closed while the connection between mixture inlet 10 and piston recess 12 is existing. The air inlet 11 opens into the piston recess 12 at the point in time LO; advantageously, this occurs approximately at the same point in time when the mixture inlet 10 opens toward the crankcase 4. Accordingly, the air inlet 11 closes relative to the piston recess 12 at the point in time LS that corresponds approximately to the point in time ES at which the mixture inlet 10 closes.

Figure 5:
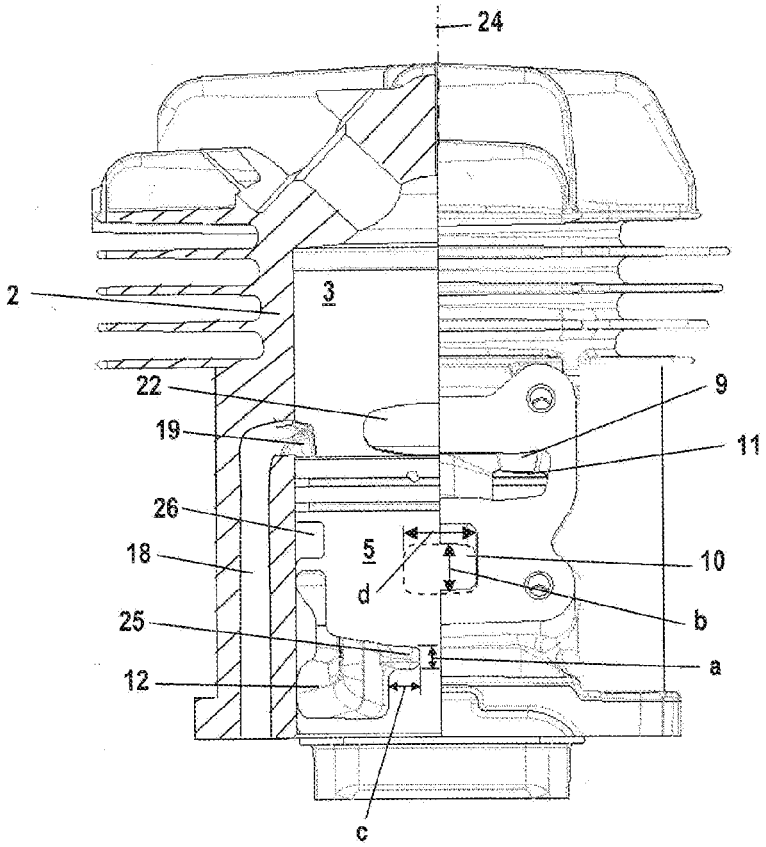
FIG. 5 is a partially sectioned side view of the cylinder of one embodiment of the two-stroke engine viewed in the direction of arrow V in FIG. 1 at bottom dead center of the piston.

FIGS. 5 to 10 show an embodiment of the cylinder 2 of a two-stroke engine 1. As shown in FIG. 5, the piston recess 12 of the piston 5 shown in FIG. 5 has a nose 25 that projects into the area of the mixture inlet 10. In this way, the nose 25 and the mixture inlet 10, upon upward stroke of the piston 5 and upon downward stroke of the piston 5, overlap each and fuel/air mixture from the mixture inlet 10 can be sucked into the piston recess 12. The nose 25 has a height a measured in the direction of the longitudinal cylinder axis 24 that is significantly smaller than the height b of the mixture inlet 10 that is also measured in the direction of the longitudinal cylinder axis 24. The height a is advantageously approximately one half to one fifth of the height b. The nose 25 extends advantageously about less than one half of the extension of the mixture inlet 10 in the circumferential direction of the cylinder 2. The nose 25 has a width c that is measured in circumferential direction of the cylinder 2 and is advantageously less than one half, in particular less than one third, of the width d of the mixture inlet 10 that is also measured in the circumferential direction. As shown in FIG. 5, the piston 5 has on the side of the piston recess 12 that is facing the combustion chamber 3 a cutout 26 that provides weight reduction of the piston 5.

Figure 6:
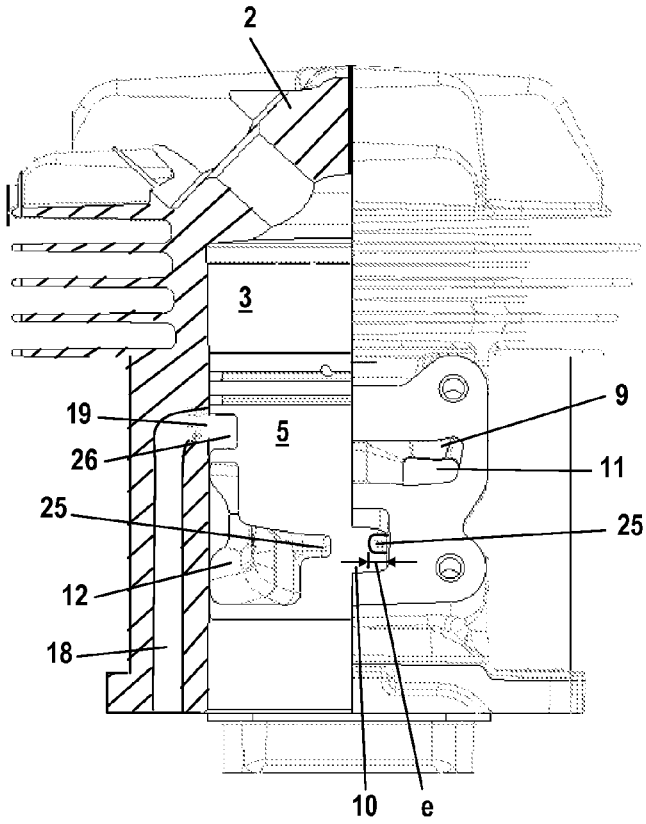
FIG. 6 shows the cylinder of FIG. 5 at the time of closing of the outlet.

FIG. 6 shows the piston 5 moved farther upwardly upon continued upward stroke. In the position of piston 5 illustrated in FIG. 6 the noses 25 of the piston recesses 12 are in the area of the mixture inlet 10 and are communicating therewith. The piston recess 12 is however still closed relative to the transfer ports 19 and 21. The transfer ports 19, 21 are in communication with the cutout 26. As shown in FIG. 6, the noses 25 have overlap e with the mixture inlet 10 measured in the circumferential direction, respectively. The overlap e corresponds to the width of the free cross-section by means of which the nose 25 is connected to the mixture inlet 10.

Figure 7:
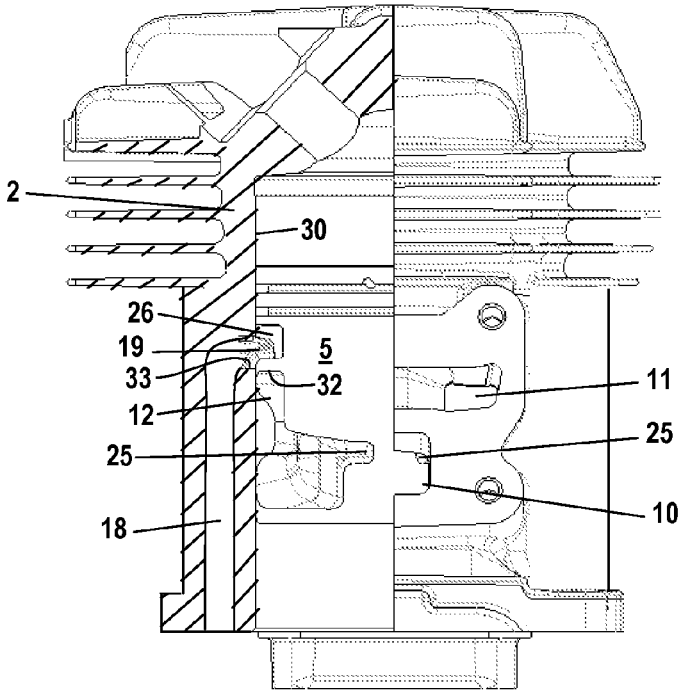
FIG. 7 shows the cylinder of FIG. 5 shortly before opening of the transfer passage.
Figure 8:
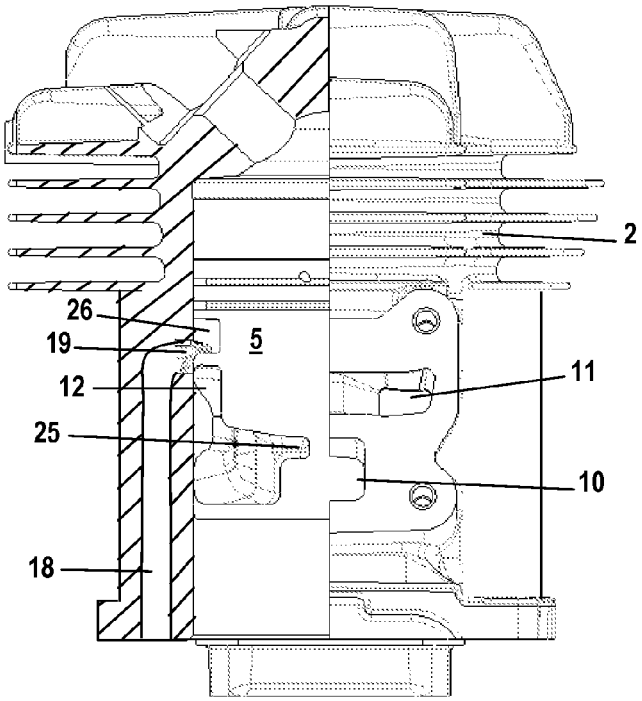
FIG. 8 shows the cylinder of FIG. 5 upon closing of the connection to the piston recess.

In the position of the piston 5 illustrated in FIG. 7 the bottom edge of the noses 25 are still in the area of the mixture inlet 10. A portion of the noses 25 is already closed off by the cylinder 2. The top edge 32 of the piston recesses 12 is located slightly below the bottom edge 33 of the transfer port 19. Upon minimal further upward movement of the piston 5 the piston recess 12 opens toward the transfer passage 18 and the mixture inlet 10 is in communication through the piston recess 12 with the transfer passage 18. This connection is however existing only for a few degrees of the crank angle α, advantageously for approximately 5° up to approximately 25° of the crank angle α, and in particular for approximately 10° up to approximately 20° of the crank angle α. Upon further upward stroke of the piston 5 the connection between the mixture inlet 10 and the piston recess 12 doses. This is illustrated in FIG. 8. The noses 25 are completely dosed by the cylinder 2. As shown in FIG. 8, the air inlet 11 is still closed by the piston 5 when the noses 25 are already closed. In this way, at no point in time a direct connection through the piston recess 12 exists between the mixture inlet 10 and the air inlet 11.

Figure 9:
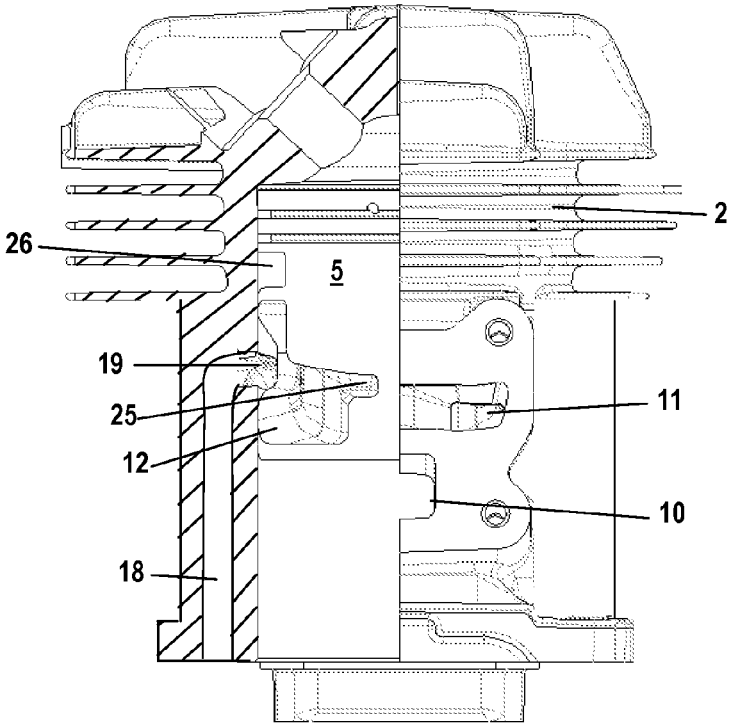
FIG. 9 shows the cylinder of FIG. 5 at top dead center of the piston.

FIG. 9 shows the piston 5 at top dead center TDC. In this position the air inlet 11 is completely open and low-fuel combustion air or substantially fuel-free combustion air from the air passage 9 is supplied to and stored in the transfer passages 18, 20. The mixture that is supplied to the transfer passages 18, 20 through the connection between the piston recess 12 and the mixture inlet 10 is thus located, in an idealized situation, between the scavenging air and the fresh mixture in the crankcase.

Figure 10:
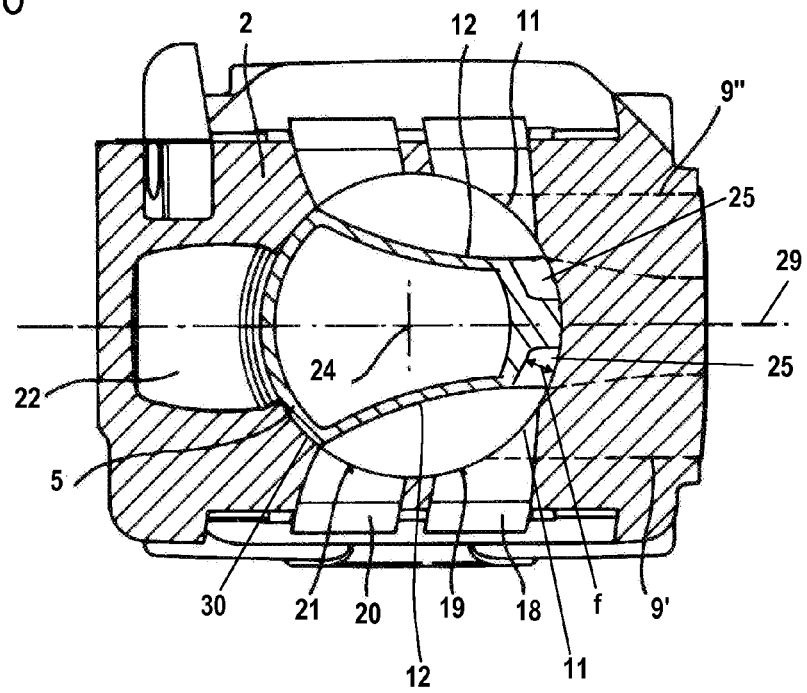
FIG. 10 is a schematic section illustration of the cylinder of FIG. 5 at the level of the line X-X of FIG. 1.

FIG. 10 shows the cylinder in section view. The noses 25 have a depth f measured radially relative to the longitudinal cylinder axis 24. The depth f is at least as large as the overlap e illustrated in FIG. 6 between the mixture inlet 10 and the nose 25 in circumferential direction. Advantageously, the depth f is greater than the overlap e. In this way, the connecting cross-section between the nose 25 and the mixture inlet 10 illustrated in FIG. 6 is the smallest flow cross-section of the flow connection and thus represents a defined throttle location.

Figure 11:
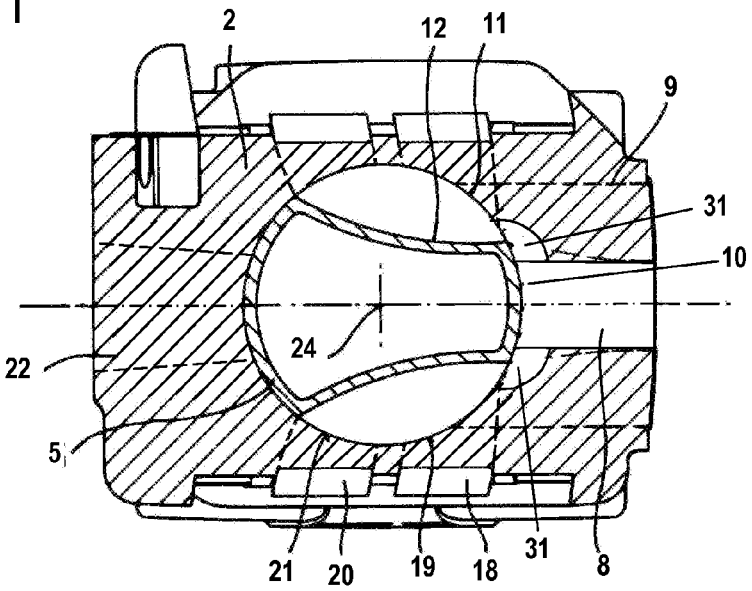
FIG. 11 is a schematic section illustration of a further embodiment of the cylinder at the level of the section line X-X of FIG. 1.

FIG. 11 shows a further embodiment. The connection between the mixture inlet 10 and the piston recesses 12 is produced by noses 31 at the mixture inlet 10 that are embodied as depressions of the wall of the cylinder bore 30. The noses 31 project into the area of the piston recesses 12 and can also project into the area of the transfer ports 19, 21.

It may be provided also that the connection between the mixture inlet 10 and the piston recess or recesses 12 is provided through a passage that is provided in the piston 5 or in the cylinder 2. The connection can also be produced by depressions in the piston 5 and in the cylinder 2.

Figure 12:
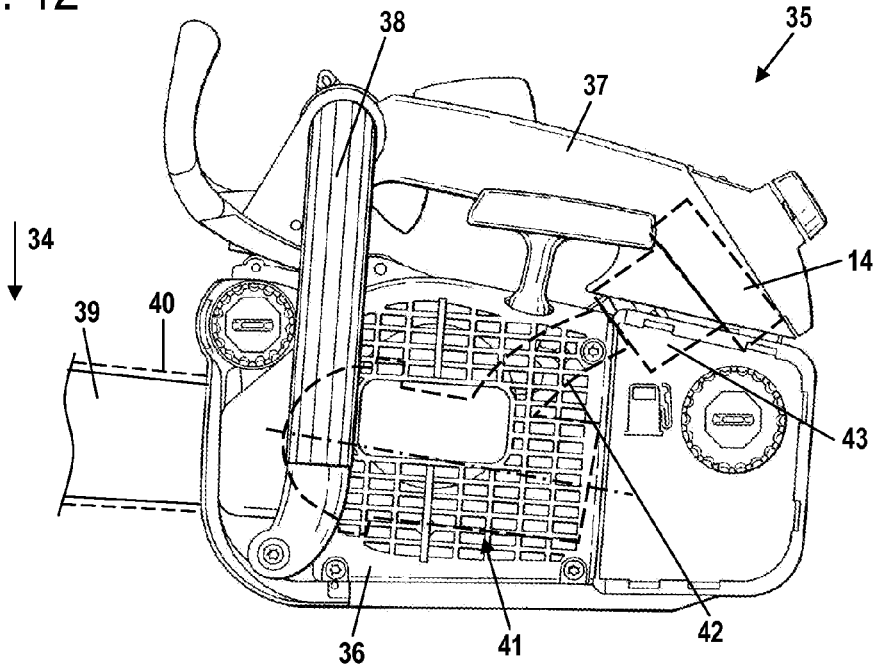
FIG. 12 is a schematic illustration of a hand-held power tool.

FIG. 12 shows a hand-held power tool, i.e., a motor chainsaw 35, with two-stroke engine 41. The motor chainsaw 35 has a housing 36 on which a top handle 37 is arranged. Moreover, a grip pipe 38 is secured on the housing 36. At the front, end of the housing 36, a guide bar 39 is arranged and projects in forward direction. A saw chain 40, only schematically indicated, is arranged on the guide bar 39 and circulates about it. The saw chain 40 is driven by the two-stroke engine 41. The position of the motor chainsaw 35 illustrated in FIG. 12 is the regular position when working with the motor chainsaw 35 and corresponds also to the position when placing the motor chainsaw 35 onto the ground. The force of gravity is acting in the direction indicated by arrow 34. In this regular position of the chainsaw, the two-stroke engine 41 is arranged horizontally in the housing 36. The intake passage 42 and the carburetor 43 as well as the air filter 14 are arranged above the cylinder 2 and the crankcase 4 (FIG. 13).

Figure 13:
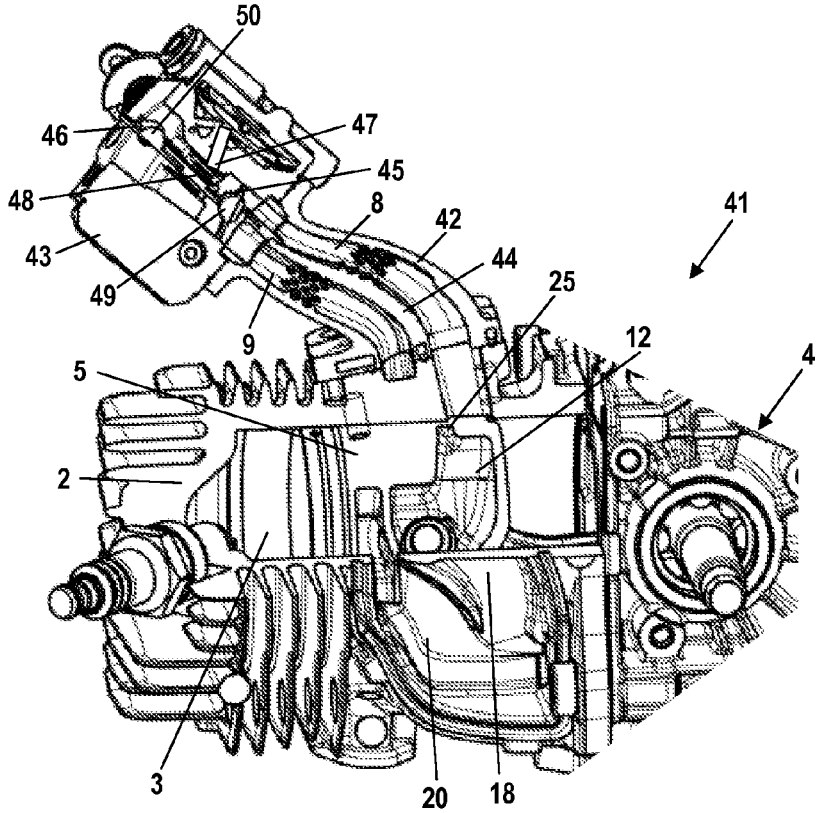
FIG. 13 is a partially sectioned illustration of the two-stroke engine of the power tool of FIG. 11.

FIG. 13 shows the two-stroke engine 41 in the usual working position of the motor chainsaw 35 illustrated in FIG. 12. The two-stroke engine 41 corresponds substantially to the two-stroke engine 1 illustrated in the preceding Figures. The same reference numerals indicate same or identically acting elements. For supplying fuel and combustion air, the two-stroke engine 41 has a carburetor 43 that is arranged above the cylinder 2. As shown in FIG. 13, a fuel port 47 opens into the intake passage 42 in the area of throttle valve 45. Upstream of the throttle valve 45, a choke valve 46 is disposed in the intake passage 42.

By means of intake passage 42 mixture is supplied through mixture passage 8 and also combustion air is supplied through air passage 9. In order to separate the two passages 8 and 9 from each other, the intake passage 42 has a partition 44. In the carburetor 43, a partition section 48 of the partition 44 is also arranged between the throttle valve 45 and the choke valve 46. As shown in FIG. 13, the partition section 48 extends to a point proximal or dose to the throttle shaft 49 and the choke shaft 50. In this way, the air passage 9 and the mixture passage 8 are substantially separated from each other, independent of the position of the throttle valve 45 and the choke valve 46. Only through the narrow gap that is formed between the partition 44 and the throttle shaft 49 or choke shaft 50 which gap is required for compensation of tolerances and for ensuring proper pivoting of the valves 45, 46, mixture can pass from the mixture passage 8 into the air passage 9 in case of closed valves. In the illustrated arrangement the fuel port 47 is arranged above the air passage 9. In this way, a transfer of fuel from the fuel port 47 through the gap that is provided between the partition 44 and the throttle shaft 49 into the air passage 9 is favored by gravity. When the throttle valve is open, the gap between the partition 44 and the throttle shaft 49 is dosed by the throttle valve 45.

The specification incorporates by reference the entire disclosure of German priority document 10 2010 045 017.0 having a filing date of Sep. 10, 2010.

While specific embodiments of the invention have been shown and described in detail to illustrate the inventive principles, it will be understood that the invention may be embodied otherwise without departing from such principles.

What is claimed is:

1. A two-stroke engine comprising:

a cylinder having a cylinder bore with a combustion chamber and an outlet communicating with said combustion chamber;

a piston disposed in said cylinder and delimiting said combustion chamber, wherein said piston has a piston recess;

a crankcase having a crankshaft rotatably supported therein;

wherein said piston drives in rotation said crankshaft;

wherein said crankcase in at least one position of said piston is connected by a transfer passage with said combustion chamber;

an air passage;

a mixture passage having a mixture inlet that is disposed at said cylinder bore and opens into said cylinder bore and is piston-controlled by said piston;

wherein said transfer passage is connected by said piston recess to said air passage when said piston is in an area of top dead center of said piston;

wherein said piston recess is connected by a first connection to said transfer passage; and wherein said piston recess is connected by a second connection to said mixture inlet in at least one position of said piston, wherein said second connection is independent of said first connection and said second connection connects said piston recess directly with said mixture inlet without said second connection utilizing said transfer passage and said crankcase.

2. The two-stroke engine according to claim 1, wherein said second connection of said piston recess is at least partially realized when said first connection is existing.

3. The two-stroke engine according to claim 2, wherein said first connection and said second connection exist simultaneously for a crank angle range of approximately 5° to approximately 25°.

4. The two-stroke engine according to claim 3, wherein said first connection and said second connection exist simultaneously for a crank angle range from approximately 10° to approximately 20°.

5. The two-stroke engine according to claim 1, wherein said air passage has an air inlet that is disposed at said cylinder bore and opens into said cylinder bore.

6. The two-stroke engine according to claim 5, wherein said air inlet is closed relative to said piston recess when said piston recess is connected by said second connection to said mixture inlet.

7. The two-stroke engine according to claim 1, wherein said piston recess is connected by said second connection to said mixture inlet when a direct connection of said mixture inlet into said crankcase is closed completely by said piston.

8. The two-stroke engine according to claim 1, wherein said piston recess is connected by said second connection to said mixture inlet when said outlet is closed by said piston.

9. The two-stroke engine according to claim 1, wherein said second connection is formed at least partially by a depression provided in said piston.

10. The two-stroke engine according to claim 1, wherein said second connection is at least partially formed by a depression provided in a wall of said cylinder bore.

11. The two-stroke engine according to claim 9, wherein said depression has a height measured in a direction of a longitudinal cylinder axis of said cylinder and said height of said depression is smaller than a height of said mixture inlet measured in said direction of said longitudinal cylinder axis.

12. The two-stroke engine according to claim 11, wherein said height of said depression is approximately one half up to one fifth of said height of said mixture inlet.

13. The two-stroke engine according to claim 9, wherein said second connection is formed by a nose provided at said piston recess, wherein said nose projects laterally into an area of said mixture inlet and is in overlap with said mixture inlet in said at least one position of said piston in which said second connection exists so that said piston recess is directly connected through said nose with said mixture inlet.

14. The two stroke engine according to claim 13, wherein, in said at least one position of said piston in which said second connection exists, said nose overlaps said mixture inlet with an overlap length measured in a circumferential direction of said cylinder, wherein said overlap length is less than one half of a width of said mixture inlet in said circumferential direction.

15. The two-stroke engine according to claim 14, wherein said overlap length of said nose in said circumferential direction of said cylinder is less than one third of a width of said mixture inlet in said circumferential direction.

16. The two-stroke engine according to claim 14, wherein in a radial direction relative to a longitudinal cylinder axis of said cylinder a depth of said nose has a length that is at least as large as said overlap length of said nose with said mixture inlet measured in said circumferential direction.

17. The two-stroke engine according to claim 1, wherein said cylinder has a center plane that divides said outlet, wherein a longitudinal cylinder axis of said cylinder is positioned within said center plane, wherein said center plane defines a first side of said cylinder and a second side of said cylinder, wherein on said first side and on said second side at least one said transfer passage and at least one said piston recess are arranged, respectively.

18. The two-stroke engine according to claim 17, wherein said piston recesses on said first and second sides are connected to each other by a connecting groove provided in said piston, wherein said connecting groove is formed as a circumferentially extending depression at a circumference of said piston, wherein, in said least one position of said piston in which said second connection exists, said connecting groove is at least partially in overlap with said mixture inlet so that said connecting groove provides said second connection between said piston recess and said mixture inlet.

19. The two stroke engine according to claim 1, comprising a common intake passage provided with a partition, wherein said air passage and said mixture passage extend at least partially in said common intake passage and are separated from each other by said partition.

20. The two-stroke engine according to claim 19, comprising a carburetor with a throttle valve pivotably supported in said carburetor, wherein in an area of said throttle valve a fuel port opens into said mixture passage.

21. A hand-held power tool with a two-stroke engine according to claim 20, wherein said fuel port in a regular working position of the power tool relative to an effective direction of gravity is arranged above said air passage.

22. A two-stroke engine comprising:

a cylinder having a cylinder bore with a combustion chamber and an outlet communicating with said combustion chamber;

a piston disposed in said cylinder and delimiting said combustion chamber, wherein said piston has a piston recess;

a crankcase having a crankshaft rotatably supported therein;

wherein said piston drives in rotation said crankshaft;

wherein said crankcase in at least one position of said piston is connected by a transfer passage with said combustion chamber;

an air passage;

a mixture passage having a mixture inlet that is disposed at said cylinder bore and opens into said cylinder bore and is piston-controlled by said piston;

wherein said transfer passage is connected by said piston recess to said air passage when said piston is in an area of top dead center of said piston;

wherein said piston recess of said piston, in at least one position of said piston, is in overlap with said mixture inlet so that said piston recess of said piston establishes a direct connection to said mixture inlet.

23. A method for operating a two-stroke engine that comprises:

a cylinder having a cylinder bore with a combustion chamber and an outlet communicating with said combustion chamber;

a piston disposed in said cylinder and delimiting said combustion chamber, wherein said piston has a piston recess;

a crankcase having a crankshaft rotatably supported therein, wherein said piston drives in rotation said crankshaft and wherein said crankcase in at least one position of said piston is connected by a transfer passage with said combustion chamber;

an air passage, wherein said transfer passage is connected by said piston recess to said air passage when said piston is in an area of top dead center of said piston;

a mixture passage having a mixture inlet that is disposed at said cylinder bore and opens into said cylinder bore and is piston-controlled by said piston;

the method comprising the steps of:

connecting said piston recess by a direct connection to said mixture inlet in at least one position of said piston, wherein said direct connection is established without utilizing said transfer passage and said crankcase;

generating underpressure in said piston recess via said transfer passage upon upward stroke of said piston; and sucking in with said underpressure generated in said piston recess a mixture from said mixture inlet into said piston recess in at least one engine speed range.

* * * * *